US006849038B2

(12) United States Patent
Straface

(10) Patent No.: US 6,849,038 B2
(45) Date of Patent: Feb. 1, 2005

(54) METHOD FOR MAKING A TOOL CONTAINER

(76) Inventor: Steven A. Straface, 28 Emerald La., Mahopac, NY (US) 10541

( * ) Notice: Subject to any disclaimer, the term of this patent is extended or adjusted under 35 U.S.C. 154(b) by 93 days.

(21) Appl. No.: 10/236,378

(22) Filed: Sep. 5, 2002

(65) Prior Publication Data

US 2003/0000859 A1 Jan. 2, 2003

Related U.S. Application Data

(62) Division of application No. 09/686,783, filed on Oct. 10, 2000, now abandoned.

(51) Int. Cl.[7] ..... B31B 3/04
(52) U.S. Cl. ..... 493/308; 493/309; 493/226
(58) Field of Search ..... 493/308, 309, 493/221, 226, 923; 383/38, 41, 66, 25, 29, 907; 206/372, 373; 150/112; 190/109

(56) References Cited

U.S. PATENT DOCUMENTS

| | | | | | |
|---|---|---|---|---|---|
| 1,666,536 | A | * | 4/1928 | Olea | 206/298 |
| 2,470,362 | A | * | 5/1949 | Moody et al. | 206/0.84 |
| 2,501,270 | A | * | 3/1950 | Fleming | 206/579 |
| 2,769,475 | A | | 11/1956 | Fisher | 150/108 |
| 2,783,875 | A | * | 3/1957 | Shabarick | 312/35 |
| 3,128,854 | A | * | 4/1964 | Specht | 206/289 |
| 3,198,300 | A | | 8/1965 | Tuttle | 150/108 |
| 4,210,186 | A | | 7/1980 | Belenson | 190/110 |
| 4,657,135 | A | * | 4/1987 | Kjose | 206/315.3 |
| 4,844,279 | A | | 7/1989 | Chalat | 220/22 |
| 4,917,279 | A | | 4/1990 | Brow et al. | 224/42.14 |
| 5,012,921 | A | * | 5/1991 | Becker | 206/315.1 |
| 5,105,919 | A | * | 4/1992 | Bomes et al. | 190/18 A |
| 5,167,170 | A | * | 12/1992 | Croteau | 76/83 |
| D337,268 | S | | 7/1993 | George et al. | D3/287 |
| 5,288,150 | A | | 2/1994 | Bearman | 150/112 |
| 5,294,029 | A | | 3/1994 | Shimura et al. | 224/162 |
| 5,427,453 | A | * | 6/1995 | Cloessner | 383/38 |
| 5,437,369 | A | * | 8/1995 | Spitere | 206/373 |
| 5,441,163 | A | | 8/1995 | Carrasco | 20/23.86 |
| 5,474,204 | A | | 12/1995 | Sutyla | 220/507 |
| 5,480,023 | A | | 1/1996 | Puller | 206/8 |
| 5,538,137 | A | * | 7/1996 | Deioma et al. | 206/579 |
| 5,553,692 | A | | 9/1996 | Sheiman | 190/18 A |
| 5,653,318 | A | | 8/1997 | Field | 190/18 R |
| 5,680,932 | A | * | 10/1997 | Dickinson et al. | 206/372 |
| 5,758,974 | A | | 6/1998 | Markowitz | 383/127 |
| 5,797,491 | A | * | 8/1998 | Fierek et al. | 206/373 |
| D397,871 | S | | 9/1998 | Bellehchilli | D3/303 |

(List continued on next page.)

*Primary Examiner*—Eugene Kim
*Assistant Examiner*—Sameh H. Tawfik
(74) *Attorney, Agent, or Firm*—Darby & Darby

(57) ABSTRACT

An improved tool container a corner-less exterior adjacent a craftsman to minimize trauma when carried and to provide better access to objects therein than convention designs. In the preferred embodiment, the tool container comprises a substantially cylindrical body having an axial length, opposing first and second ends, and an interior region for tools, couplings, and assorted workpieces. The body includes at least one divider disposed between the first and second ends. Accesses are disposed along the cylindrical body on either side of the divider(s) and provide access to divided portions of the interior region of the tool container. End caps are disposed proximate to the first and second ends of the cylindrical body. A flattened portion can be provided in the cylindrical body to prevent rolling when placed on the ground or other rest surface. A method for manufacturing such a tool container is also disclosed in which a substantially cylindrical tube is provided, accesses are formed in a side wall of the tube and dividers are affixed between the accesses. Ends of the tube are capped with end caps. Optionally, a portion of the side wall is flattened during manufacturing. Also disclosed is an arrangement of tool containers within a vehicle.

1 Claim, 3 Drawing Sheets

U.S. PATENT DOCUMENTS 5,803,586 A * 9/1998 Velez et al. ..... 362/154
5,868,227 A * 2/1999 Garcia ..... 190/112
5,887,711 A * 3/1999 McAuliffe ..... 206/292
6,059,109 A * 5/2000 Stein ..... 206/373
6,062,385 A * 5/2000 Cho ..... 206/373
6,196,718 B1 * 3/2001 DeChant ..... 383/66

* cited by examiner

METHOD FOR MAKING A TOOL CONTAINER

This application is a Div of 09/686,783 filed Oct. 10, 2000 now abandoned.

FIELD OF THE INVENTION

The present invention relates to containers for tools and more particularly relates to an improved tool container housing and a method for its manufacture.

BACKGROUND OF THE INVENTION

Tool boxes of various constructions are well known in the art. One problem with known tool box constructions is that they can cause trauma (e.g., black and blue marks) when carried due to impact with the user, for example when carried by a pivoting handle. Another problem with many tool boxes is that their use in the field does not comply with Government guidelines (e.g., put out by the Occupational Safety and Health Administration). OSHA, for example, requires that a worker have both hands on a ladder as he or she climbs or descends the ladder, and this means that all tools must be carried on a belt or brought to a desired spot in another way (e.g., by a hoist). Existing tool boxes also present difficulties to workers who sometimes need to retrieve specific tools and workpieces (e.g., a pipe coupling or electrical socket) from their trucks with minimal fuss or delay. The shape of existing tool boxes, and the arrangement of their openings relative to the sides of such containers, can result in tools and workpieces being "lost" in the corners or difficult to locate. The present invention overcomes these deficiencies in an improved tool container construction and its method of manufacture.

SUMMARY OF THE INVENTION

The present invention overcomes deficiencies in prior art tool container designs by providing a well engineered outer dimension which simultaneously provides better access to objects contained within the container and reduced trauma to the craftsman who has to carry it.

In one aspect, the invention provides an improved tool container comprised of a substantially cylindrical body. The body has an axial length, opposing first and second ends, and defining an interior region therein in which tools, couplings, and assorted workpieces can be housed. The body includes at least one divider disposed between the first and second ends of the cylindrical body. Accesses are disposed along the cylindrical body on either side of the divider(s) and provide access to divided portions of the interior region of the tool container. End caps are disposed proximate to the first and second ends of the cylindrical body.

In a preferred arrangement, the end caps are recessed inwardly of the first and second ends so as to define a cavity which is sufficient in depth to permit the tool container to be grasped in someone's hands. Optionally, a grip can be positioned within or extend outside of the cavity to aid a person in grasping the tool container. Optionally, a handle can be affixed to each of said end caps as a specific form of a grip.

The divider(s) preferably are sized so as to be substantially coextensive with a dimension of said interior region. When dividers are provided of this dimension, objects placed within the divided portions of the tool container will not intermix.

The tool container preferably is provided with a flattened portion in the cylindrical body. The flattened portion can be defined along an exterior of the substantially cylindrical body and preferably generally opposite the accesses, to prevent rolling when placed on the ground or other rest surface. Alternatively or in addition, the tool container can be provided with a support generally opposite the accesses, with the support providing a surface to prevent the tool container from rolling.

The tool container optionally includes an adjustable length strap to permit craftsmen of different height to comfortably carry the tool container. The adjustable strap, if provided, is coupled to the substantially cylindrical body of the tool container at two or more spaced locations along its axial length. A reel can comprise one of the couplings. The reel is rotatable to take up or release a portion of the strap's length and thereby permit adjustment of the strap.

Optionally, the tool container includes one or more covers which are movable so as to selectively cover individual accesses or all of the accesses at once.

In accordance with another aspect of the invention, a method is provided for manufacturing a tool container generally of the construction described above. The manufacturing method commences with the step of providing a substantially cylindrical tube having a side wall and first and second ends. Processing steps are then performed on the tube to construct a finished tool container. A plurality of accesses. At some point in the process, the first and second ends of the tube are capped with end caps.

In a particularly preferred manufacturing method, in addition to the steps outlined above, an additional step of flattening a portion of the side wall is performed. The step of flattening a portion of the side wall preferably includes the steps of heating the side wall until it softens, and then pressing the softened side wall against a generally planar edge or surface.

In further, optional manufacturing steps, handles can be affixed to the end caps, a cover can be movably affixed to the tube to permit selective access to the accesses.

In a further aspect of the invention, an arrangement of tool containers within a vehicle is disclosed. The arrangement includes a plurality of tool containers of the type described above in combination with a plurality of supports attached to the vehicle at a prescribed minimum spacing from one another. The tool containers are removably seated on the supports.

These and other aspects, features and benefits of the present invention can be better understood with reference to the accompanying Drawings and Detailed Description of the Preferred Embodiment.

DETAILED DESCRIPTION OF THE PREFERRED EMBODIMENT

By way of overview and introduction, the present invention, the present invention is described in connection with a preferred embodiment in which the tool container is sized so that it may be carried in two hands or suspended from a craftsman's shoulder. The tool container of the present invention, however, can take on a variety of sizes to suit the type of workpiece(s) that it is to store. The container can house a number of workpieces to address a variety of contractor needs. By way of example only, the container can include a variety of pipe couplings such as straight and elbow connectors and assorted pieces of PVC and copper tubing. For other contractors, the container might contain electrical switches, outlets, telephone jacks, coaxial cable fittings, and the like.

Figure 1:
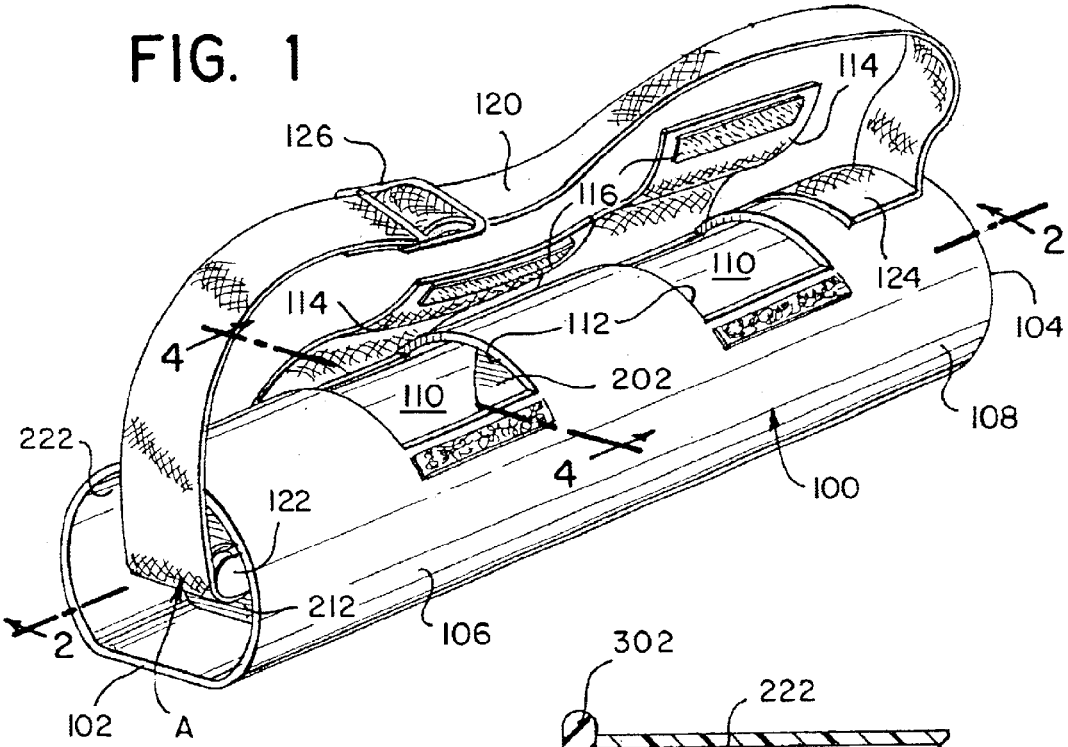
FIG. 1 illustrates a perspective view of a tool container in accordance with a preferred embodiment of the invention.

With reference now to FIG. 1, a preferred embodiment of a tool container 100 is illustrated. The tool container 100 has spaced and opposing first and second ends 102, 104. An elongated body 106 extends between the ends 102, 104. In the preferred embodiment, as illustrated, the body 106 is substantially cylindrical in shape. The substantially cylindrical shape of the body 106 defines a corner-free exterior 108 between the ends 102, 104 which provides particular benefits when carried by the craftsman, as described more fully below.

The cylindrical body 106 is hollow and defines an interior region 110. Accesses 112 are formed in the cylindrical body to provide access to the interior region 110, and one or more covers 114 are mounted for selective positioning over the accesses to thereby close the access. A closure mechanism 116 such as a hook and loop fastener, zipper, snap optionally is arranged to secure the cover 114 in a closed position (not shown).

Figure 2:
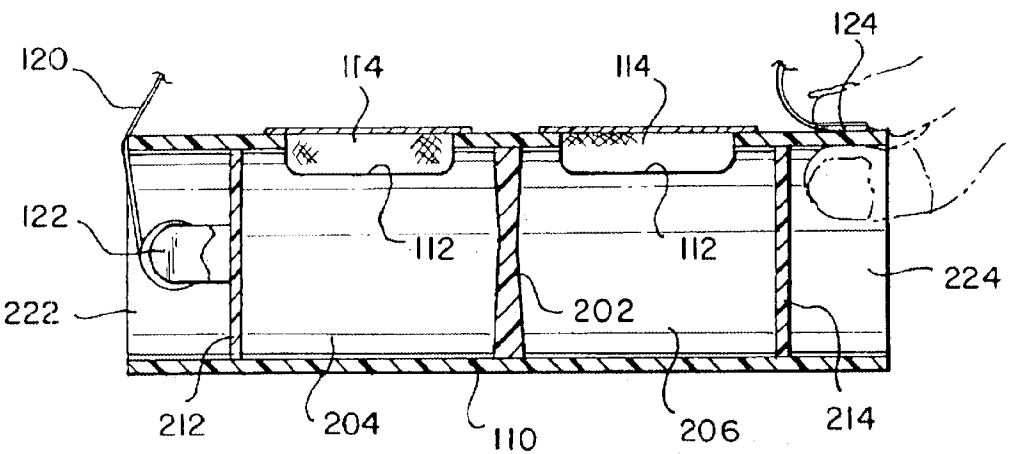
FIG. 2 is an axial cross-section taken along line 2—2 of FIG. 1.

As shown in the cross-sectional view of FIG. 2, a divider 202 is disposed between the ends 102, 104 of the tool container. The accesses 112 are shown positioned in either side of the divider 202, but the divider can be positioned in register with one of the accesses 112. Multiple dividers 202 can be included, although only one is shown in FIG. 2. The divider defines distinct portions 204, 206 within the interior region 110 and serves to define compartments within the tool container 100, if desired. The dividers can be permanently affixed within the interior region 110, or can be selectively inserted or removed, as needed. Preferably, the dividers are shaped so as to define an obtuse angle Φ at the union of the divider 202 and the interior wall 208 of the cylindrical body. The obtuse angle Φ makes it easier for the craftsman to extract a small workpiece from the portions 204, 206. A number of shapes can be used such as triangular and hourglass (as shown). The dividers can be sized so as to be generally coextensive with the diameter or size of the interior region 110 of the tool container when positioned as shown in FIG. 2, to prevent objects placed within the portions 204, 206 from intermixing.

FIG. 2 also illustrates end caps 212, 214 which are mounted proximate to the opposing first and second ends 102, 104 of the body. The end caps 212, 214 delimit one end of a defined portion of the tool container 100. For example, the tool container illustrated in FIG. 2 has the portion 204 defined by the end cap 212 and the divider 202 whereas the portion 206 is defined by the divider 202 and the end cap 214. Were further portions provided, they would be defined between plural dividers 202.

The end caps 212, 214 are preferably recessed inwardly of the first and second ends of the body 106 to thereby define respective cavities 222, 224. The cavities 222, 224 can be sized so as to permit the tool container to be grasped by fingers of two hands of the craftsman.

Figure 3:
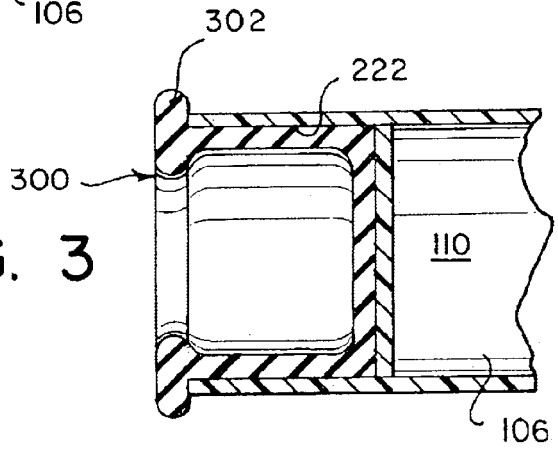
FIG. 3 is a radial cross-section taken along line 3—3 of FIG. 1.

FIG. 3 illustrates an optional a grip 300 as having been mounted within the cavity. The grip can be a type of end cap, in which case there would be no need for the end caps 222, 224. Preferably, the grip is molded element which is shaped to fit the natural grasp of the craftsman's hands. One suitable material for the grip is a hard rubber. The grip 300 is seated, at least in part, within the cavities 222, 224. The grip can be provided with a radial projection 302 which extends radially outwardly beyond the diameter of the cylindrical body 106 to provide frictional engagement to the ground or another surface, and can be shaped so as to stem any tendency for the tool container 100 to roll, e.g., by having one or more flat surfaces (including a flat surface generally opposite the accesses 112). The grip 300 can be affixed within the cavities 222, 224, for example, by a friction fit, by an adhesive, by a heat weld.

Figure 4:
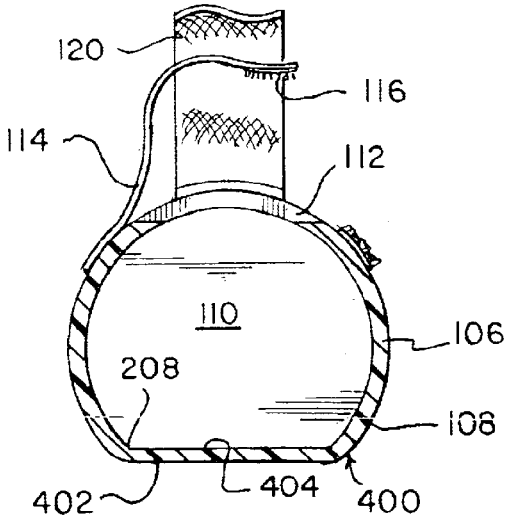
FIG. 4 is a cross-sectional view of the tool container of FIG. 3, showing a feature of a second embodiment.

With reference now to FIG. 4, a radial cross section illustrates a flattened portion 400 along the body 106 according to the preferred embodiment. The flattened portion 400 includes an exterior flattened portion 402, and an interior flattened portion 404, though a single flattened portion can be provided or formed in the body 106, for example, a flattened exterior portion 402 and a substantially cylindrical interior wall 208. Preferably, the flattened portion 400 is generally opposite the accesses 112 so that the tool container 100 can rest in a stable state on the ground or some other surface while the craftsman accesses the interior portions 204, 206 to get various workpieces.

Figure 5:
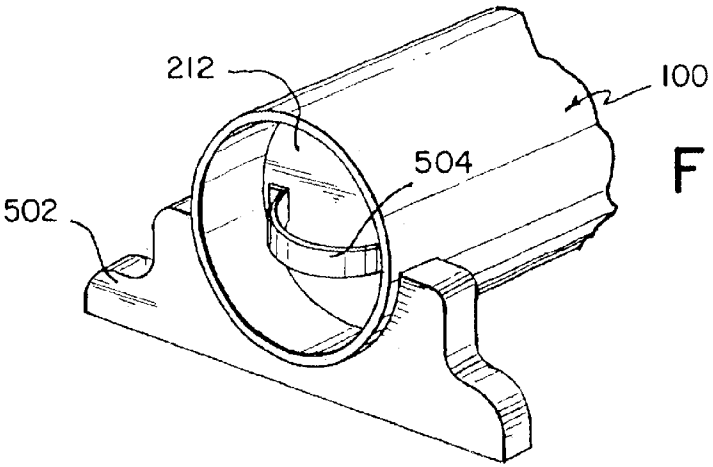
FIG. 5 is an end view of the tool container of FIG. 3, showing a feature of a third embodiment.

FIG. 5 shows an optional support 502 which provides a surface to prevent the tool container 100 from rolling when placed on the ground, table, or other surface. The support 502 can be affixed to the body 106 instead of imparting a flattened portion 400 to the tool container. The support can be made of a variety of materials and can be attached in any number of ways. As with the flattened portion, the support 502 is preferably disposed generally opposite the accesses 112.

FIG. 5 also illustrates a handle 504 affixed to the end cap 212. A similar handle would be affixed to the end cap 214 if any handles are provided at all, so that the craftsman can pick up the tool container 100 by the handles 504, instead of carrying the container by the edge of the interior wall 208 (see FIG. 2).

With reference again to FIG. 1, the tool container optionally includes an adjustable length strap 120 which is coupled to the body 106 at two or more spaced locations 122, 124 along its axial length. The strap can include a buckle 126 to permit a portion of the strap to be doubled over for strap shortening or to be slackened for strap lengthening. Alternatively or in addition, a reel mounted for rotational movement can be affixed to the body 106 or the end cap 222 (as shown) and coupled to one end of the strap 120. Rotation of the reel causes the length of the strap to be adjusted (see arrow A).

It can now be appreciated that the tool container 100 of the preferred embodiment provides a generally cylindrical container with accesses to its interior through the cylindrical side wall. The container is carried by the craftsman with the cylindrical body positioned horizontally for good weight distribution, or at a slight angle (e.g, if carried upon one's shoulder using the strap 120). The particular arrangement of the accesses 112 and the carry mechanism (whether in the form of cavities 102, 104, grips 300, handles 504, or a strap 120) cause the tool container 100 to present only smooth, curved surfaces proximate to the craftsman's body. That is, the lower margin of the tool container 100, even if it has a flattened portion 400, does not define an exterior corner. As a result, if the body 106 of the tool 100 container bumps into the craftsman while being carried, the point of impact between the craftsman and the exterior 108 is blunt due to the curved surfaces, and is less likely to cause trauma. In addition, the adjustable strap 120 can be used to adjust where the tool container 100 rests relative to the craftsman's body and thereby shift the point of contact; however, it is the shape of the exterior wall 108 which provides the greatest advantage over prior art designs in ameliorating injury from use. In contrast, the hard shells of conventional tool containers are generally characterized as having a pivoting carry handle which permits a bottom corner to swing and bump into the craftsman. When filled, such a heavy container can cause substantial trauma upon impact, especially after repeated impact in the same location (e.g., when carried all day in the same hand).

Figure 6:
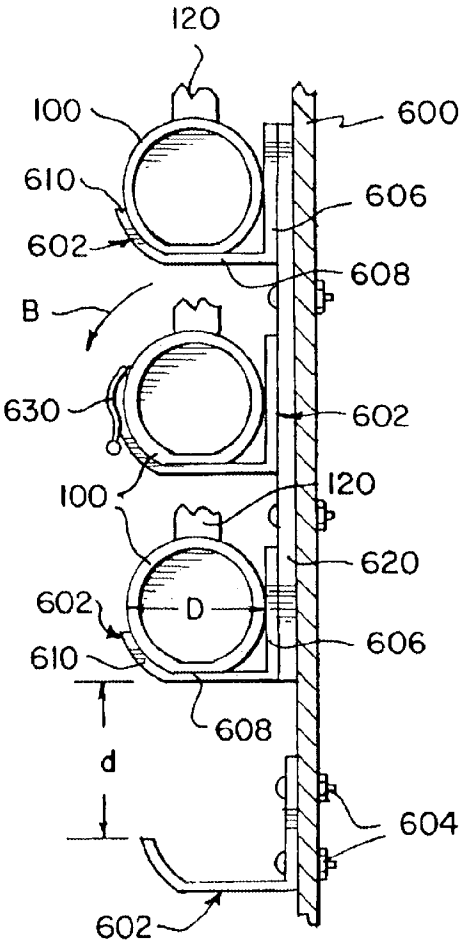
FIG. 6 is a radial cross-section of the tool container of the present invention compactly arranged along a wall of a truck, van or the like for ready access to its contents.

Turning now to FIG. 6, several tool containers 100 are shown compactly arranged along a wall 600 of a truck, van or the like for ready access to its contents. A number of supports 602 are mounted to the wall 600 in any conventional manner, such as by nuts and bolts 604. The supports 602 include a brace 606 which is seated against the wall 600, a ledge 608 which extends away from the wall, preferably generally horizontally, and a lip 610 which extends upwardly. Together, the ledge and lip define a pocket 612 which cradles the tool container 100 when seated on the ledge 608. The lip 610 is preferably sized so as to minimize any chance that the tool container could dislodge during transit of the truck, van, or other vehicle.

The supports are mounted on the wall 600 and spaced from one another so as to permit ready insertion and removal of the tool container into the pocket 612. In other words, if the tool container 100 has a diameter "D," then the distance "d" between the lip 610 and the underside of the ledge 608 is greater than diameter "D." A number of the supports can be mounted to the wall 600 by way of a pre-drilled bracket 620, or can be provided mounted to the bracket 620 for affixing to the wall 600. The bracket 620 ensures proper spacing between adjacent supports 602 in order to most compactly arrange the tool containers 100 within a vehicle.

In use, the craftsman can remove one or more tool containers from his or her vehicle at a job site and have a selection of parts or tools available for a given type of job, for example. Alternatively, the craftsman can access interior portions 204, 206 of the tool container while the tool container remains cradled in the support 602 by rotating a given tool container in the direction of arrow B, for example, by grabbing the edge of one or two of the accesses 112, or by pulling on a cord 630. The cord 630, if provided, is anchored to the body 106 in any conventional manner (e.g. is knotted within a throughhole). Preferably, the tool container has a curved interior wall 208 which permits the contents of the tool container to shift smoothly as the container is rotated.

Figure 7:
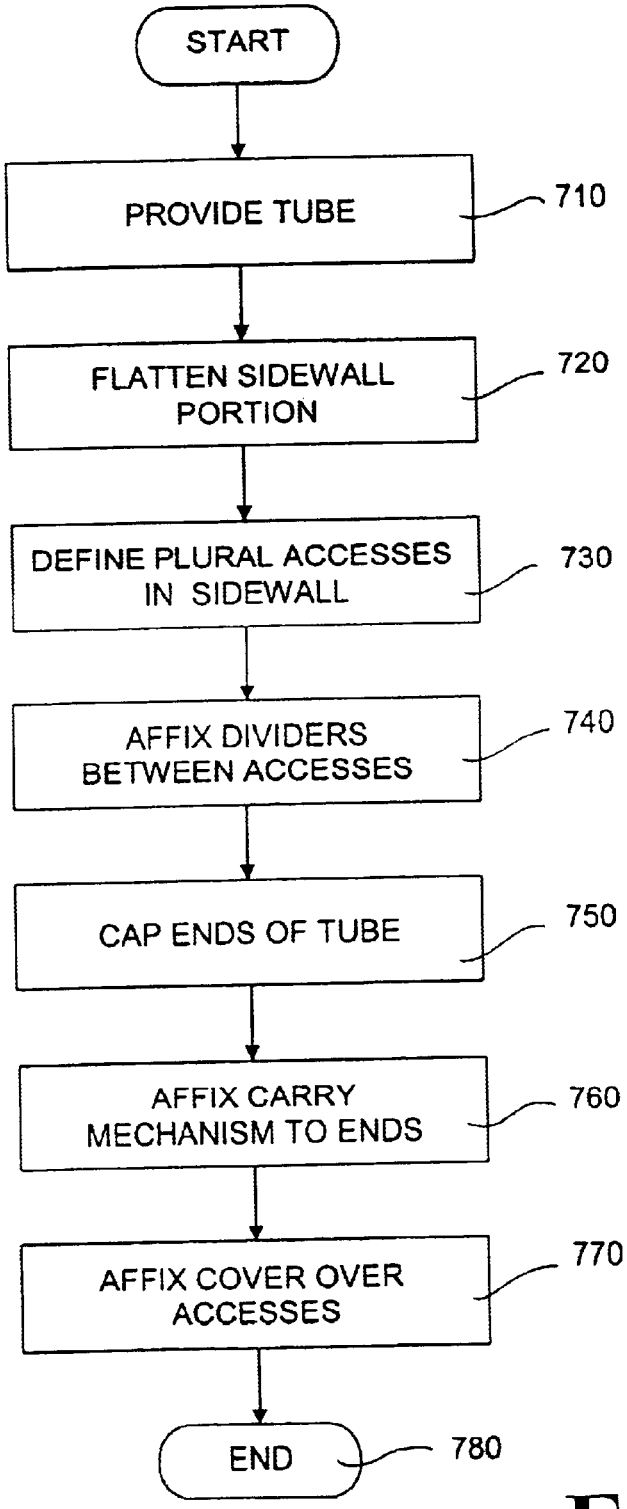
FIG. 7 is a flow chart detailing process steps for manufacturing a tool container in accordance with the present invention.

FIG. 7 illustrates the process steps in a manufacturing method for fabricating a tool container of the type described above. At step 710, a substantially cylindrical tube 106 is provided of the type having a side wall and first and second ends. The tube 106 is preferably made of PVC or another, hard plastic material. A portion of the side wall can be flattened, as indicated at step 720. The step of flattening the side wall preferably includes the steps of heating the side wall of the tube until it softens, and then pressing said softened side wall against a flat surface or edge.

At step 730, a plurality of accesses are formed in the side wall of the tube, for example, by cutting through the side wall. The side wall can be cut in any conventional manner using a tool suitable for cutting through the material of the tube. One or more dividers are affixed between the accesses, either permanently or so that they can be removed by the craftsman, if that is desired, as indicated at step 740. The dividers can be seated in slots or between ridges formed in or on the interior wall 208, with the dividers being snapped in place by a mild rotation into a radial orientation relative to the axis of the tube 106. At step 750, the first and second ends of the tube are capped with end caps.

Optionally, a carry mechanism such as the strap 120, grip 300, or handle 504 can be affixed to the end caps, as indicated at step 760. The carry mechanism can be affixed to the end caps, or proximate the end caps near the first and second ends of the tube 106. Also, a cover can be affixed to the tool container in a manner that permits it to be selectively positioned so as to block or permit access to the accesses. The manufacturing method ends at step 780, though additional steps can be preformed to provide one or more of the features described above in connection with FIGS. 1–5.

While the present invention has been described with respect to a particularly preferred embodiment, the invention is susceptible to implementation in other ways which are within the spirit of the invention which is defined in terms of the recitations of the appended claims and equivalents thereof.

I claim:

1. A method for manufacturing a tool container, comprising the steps of:

a) providing a substantially rigid cylindrical tube having a lengthwise direction, a side wall and first and second ends, said sidewall defining an interior region of said tube;

b) forming a plurality of openings through said side wall to provide access to said interior region;

c) arranging one or more dividers inside the cylindrical tube substantially transverse to said lengthwise direction in such a manner that said interior region is divided into separate compartments and each of said openings provides access to one of said separate compartments;

d) capping said first and second ends with end caps, so that the interior region is delimited at said first and second ends by the end caps and the dividers are disposed inside the interior region between the end caps;

e) affixing a carry mechanism proximate to said end caps;

f) heating said side wall until said side wall softens; and g) pressing said softened side wall against a generally planar edge or surface until a portion of said side wall of said substantially rigid cylindrical tube is flattened.

* * * * *